US005882219A

United States Patent [19]

Samejima et al.

[11] Patent Number: 5,882,219

[45] **Date of Patent: *Mar. 16, 1999**

[54] MOVABLE CONNECTOR HAVING AN EXTENDING SUPPORT PLATE

[75] Inventors: Masakuni Samejima; Isao Kameyama; Hideto Kumakura; Satoru Kaneko, all of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 722,322

[22] Filed: Sep. 27, 1996

[30] Foreign Application Priority Data

Sep. 28, 1995 [JP] Japan ..... 7-251061

[51] Int. Cl.[6] ..... H01R 13/73

[52] U.S. Cl. ..... 439/247; 439/571

[58] Field of Search ..... 439/247, 248, 439/567, 571, 572

[56] References Cited

U.S. PATENT DOCUMENTS

| | | | |
|---|---|---|---|
| 4,820,180 | 4/1989 | Mosquera et al. | 439/248 |
| 4,988,308 | 1/1991 | Toedtman | 439/248 |
| 5,286,222 | 2/1994 | Yagi et al. | 439/248 |
| 5,302,134 | 4/1994 | Thomas et al. | 439/247 |

FOREIGN PATENT DOCUMENTS

| | | |
|---|---|---|
| 631351 A2 | 6/1994 | European Pat. Off. . |
| 0 631 351 | 12/1994 | European Pat. Off. . |
| 4013189 A1 | 10/1990 | Germany . |
| 4024348 A1 | 1/1992 | Germany . |
| 2 268 839 | 1/1994 | United Kingdom . |
| 2268839 A | 1/1994 | United Kingdom . |

*Primary Examiner*—Gary Paumen
*Attorney, Agent, or Firm*—Sughrue, Mion, Zinn, Macpeak & Seas, PLLC

[57] ABSTRACT

A movable connector 21 for absorbing misregistration thereof with a mating connector when the two connectors are fitted together includes a connector housing 23, a support plate 25 which is formed integrally with the connector housing 23, and is parallel to a plane perpendicular to an axis e of fitting of the connector housing 23, and a retaining portion 29 which is formed on and projects from one face of the support plate 25 facing away from a connector fitting surface 27 of the connector housing 23, and is movably retained in a mounting hole 35 formed in a mounting member 33.

5 Claims, 7 Drawing Sheets

MOVABLE CONNECTOR HAVING AN EXTENDING SUPPORT PLATE

BACKGROUND OF THE INVENTION

1. Field of the Invention

This invention relates to a movable connector which is movably mounted on a mounting member so as to correct a misregistration thereof with a mating connector when the two connectors are fitted together.

2. Related Art

Various accessories mounted on vehicles require electric power. For example, in the mounting of a cabin lamp, as shown in FIG. 12, a mounting construction is used in which a vehicle body-side connector 3, having a wire 1 connected thereto, is mounted on a mounting member (roof bow) 5. A lamp-side connector 7 for engaging with the vehicle body-side connector 3 is mounted on the lamp housing 9. Electrical connection is completed simultaneously with the mounting of the lamp housing 9. In such a mounting construction, in order to correct for relative misregistration between the two connectors 3 and 7, the vehicle body-side connector 3 needs to be fitted relative to the lamp-side connector 7 while moving the vehicle body-side connector 3 in accordance with the position of the lamp-side connector 7 when the lamp 9 is to be mounted.

Therefore, there has been proposed a so-called "movable connector" which is movable so as to correct a misregistration developing when mounting the lamp. FIG. 13 is a side-elevational view of such a conventional movable connector. In this movable connector 11, elastic retaining piece portions 15 are formed on a rear surface of a connector housing facing away from a fitting open portion 13, and retaining projections 15*a* of these elastic retaining piece portions 15 are retainingly engaged with a peripheral edge portion of a mounting hole 17, thereby retaining the movable connector 11 on a roof bow 5.

This movable connector 11 is thus retained relative to the mounting hole 17 through the elastic retaining piece portions 15. Therefore the movable connector is allowed to slightly move because of elastic deformation of the elastic retaining piece portions 15, thereby correcting for misregistration thereof with a mating connector (not shown).

In the conventional movable connector 11, however, the elastic retaining piece portions 15, are projected from the back of the connector housing. Therefore, the movable connector 11 projects from the mounting surface 5*a* of the roof bow 5 by an amount corresponding to the overall length of the connector housing. Therefore, a large reception space needs to be provided between the mounting surface 5*a* and an interior material (ceiling plate) 19.

As noted above, the conventional movable connector 11 can be moved only by elastic deformation of the elastic retaining piece portions 15. Therefore the direction of movement (indicated by arrow X) is linear in the direction perpendicular to the axis c of insertion of the elastic retaining piece portions 15. According to such construction, the connector can not be moved in other directions such as a rotation direction. Therefore, there are occasions when misregistration can not be satisfactorily corrected.

Furthermore, in the conventional movable connector 11, the rear surface of the connector housing is held against the mounting surface 5*a*, and therefore the movable connector can not be moved in a connector-fitting direction (that is, a direction perpendicular to the mounting surface 5*a*). Consequently, when an excessive insertion force is applied to the movable connector 11, there is a possibility that the connector housing and other portions will be damaged.

The present invention has been made in view of the above problems, and an object of the invention is to provide a movable connector in which the distance between the movable connector-mounting surface and a fitting open surface is reduced. Additional objects of the invention are that the connector can be rotated or turned in a plane parallel to the mounting surface, and also can be moved in a direction perpendicular to the mounting surface so that an excessive load, acting in a connector-fitting direction and a connector-disconnecting direction, can be relieved, thereby enhancing a misregistration-correcting function and also preventing damage to the connector.

SUMMARY OF THE INVENTION

The above objects and advantages of the present invention have been achieved by a movable connector capable of correcting for misregistration thereof with a mating connector. The inventive connector comprises a connector housing; a support plate which is formed integrally with the connector housing, and is parallel to a plane perpendicular to an axis of fitting of the connector housing; and a retaining portion which is formed on and projects from one face of the support plate facing away from a connector fitting surface of the connector housing, and is movably retained in a mounting hole formed in a mounting member.

Preferably, a distal end portion of the support plate is elastically displaceable about a connection portion thereof, in a direction generally perpendicular to the plane of the support plate.

In the movable connector of this construction, the retaining portion is retained in the mounting hole, and the connector housing is disposed out of registry with a mounting surface of the mounting member. Therefore, even when the mounting space between the mounting surface and a ceiling plate is narrow, the connector housing can be received in a reception space if the mounting space, corresponding to the thickness of the support plate, is secured. When an excessive load acts on the connector housing during the connection and disconnection of the movable connector relative to the mating connector, the support plate is elastically displaced, thereby preventing the undue load from acting on the retaining portion and the connector housing.

DETAILED DESCRIPTION OF THE PREFERRED EMBODIMENTS

A preferred embodiment of a movable connector of the present invention will now be described in detail with reference to the drawings.

Figure 1:
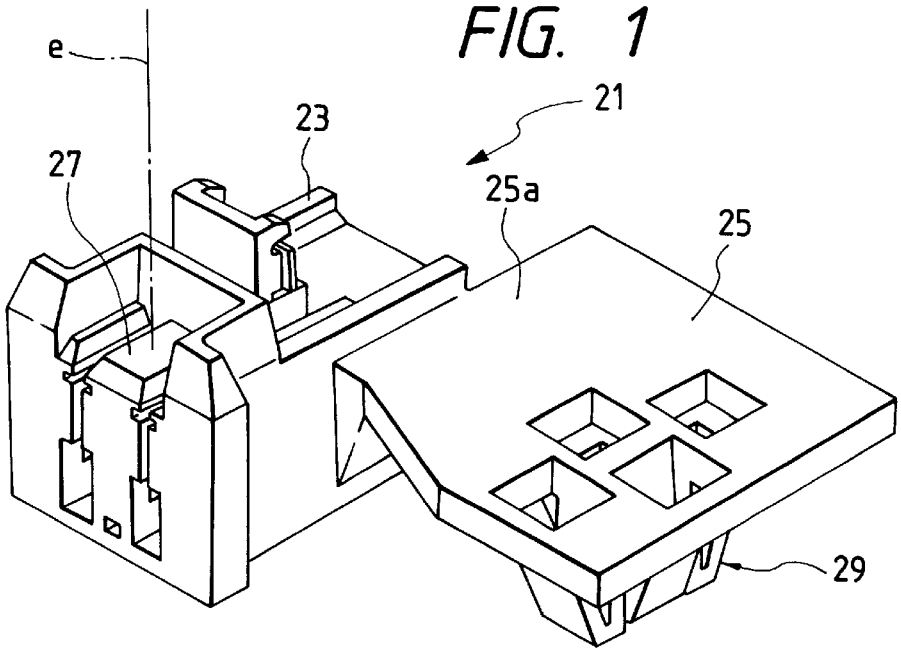
FIG. 1 is a perspective view of a movable connector of the present invention as seen from a connector-fitting surface side.
Figure 2:
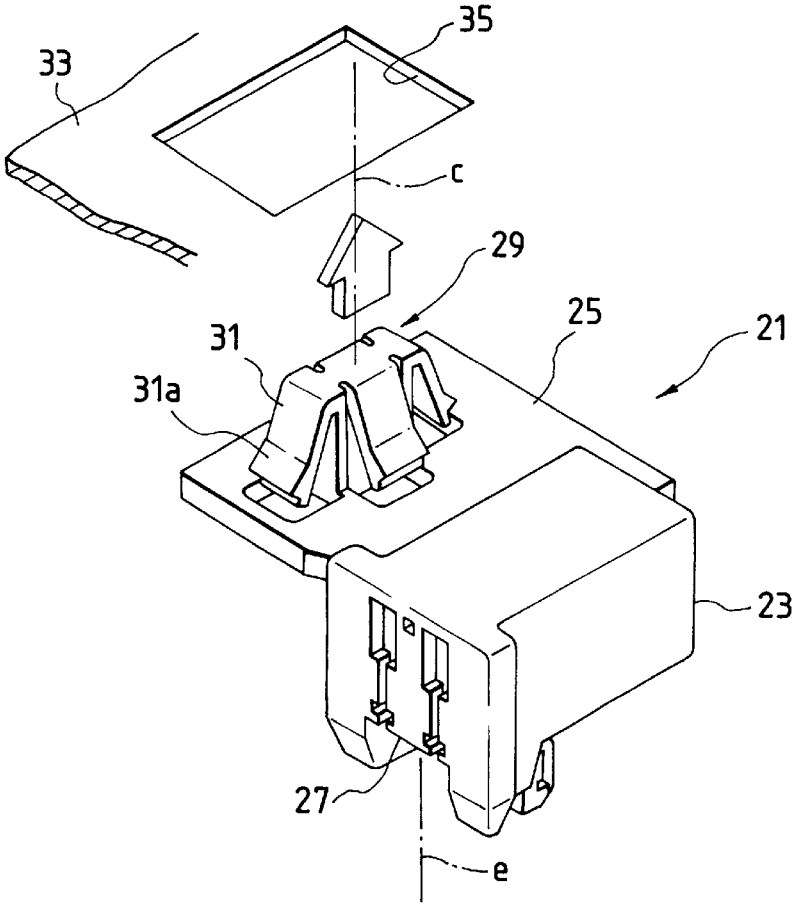
FIG. 2 is a perspective view of the movable connector of FIG. 1 as seen from a retaining portion side.

FIG. 1 is a perspective view of the movable connector of the invention as seen from a connector-fitting surface side, and FIG. 2 is a perspective view of the movable connector of FIG. 1 as seen from a retaining portion side.

As shown in FIG. 1, a support plate 25 is formed integrally with a connector housing 23 of the movable connector 21, and is parallel to a plane perpendicular to an axis e of fitting of the connector. The support plate 25 is formed integrally with the connector housing 23 made of a resin material, and therefore a distal end portion of the support plate 25 is elastically displaceable about a connection portion 25*a* in a direction generally perpendicular to the plane of the support plate.

As shown in FIG. 2, a retaining portion 29 is formed on and projects from that side or face of the support plate 25 facing away from a connector fitting surface 27. Elastic retaining piece portions (clips) 31 are provided respectively at four sides of the retaining portion 29, and each of the clips 31 can be retained at its retaining projection 31*a* on a corresponding side of a peripheral edge of a rectangular mounting hole 35 formed through a mounting member (roof bow) 33. The clips 31 are connected together at their upper or proximal ends, and their downwardly-directed free or distal end portions are movable. The clips 31 are inserted into the mounting hole 35, with their proximal ends first introduced into this mounting hole 35. Thus, in the movable connector 21, the connector fitting axis e is spaced from an axis c of insertion of the retaining portion 29 in parallel relation thereto.

Figure 3:
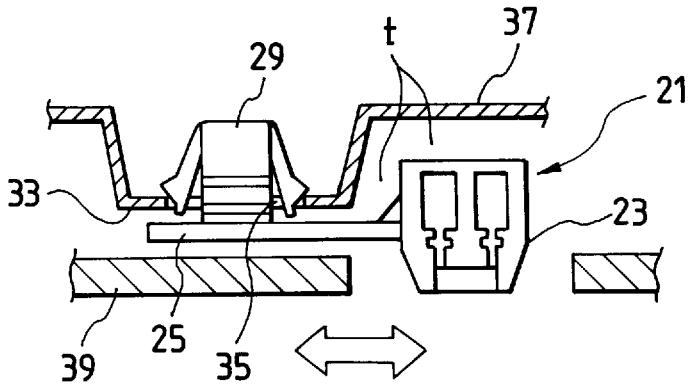
FIG. 3 is a side-elevational view showing a condition in which the movable connector of FIG. 1 is mounted on a mounting member.
Figure 4:
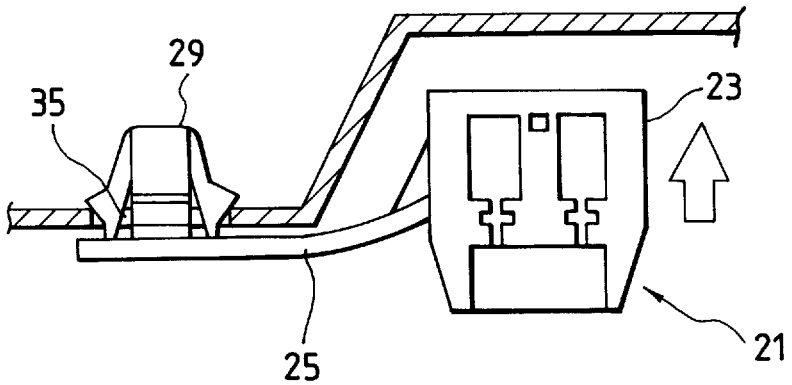
FIG. 4 is a side-elevational view showing a condition in which a load in a fitting direction is applied to the movable connector.
Figure 5:
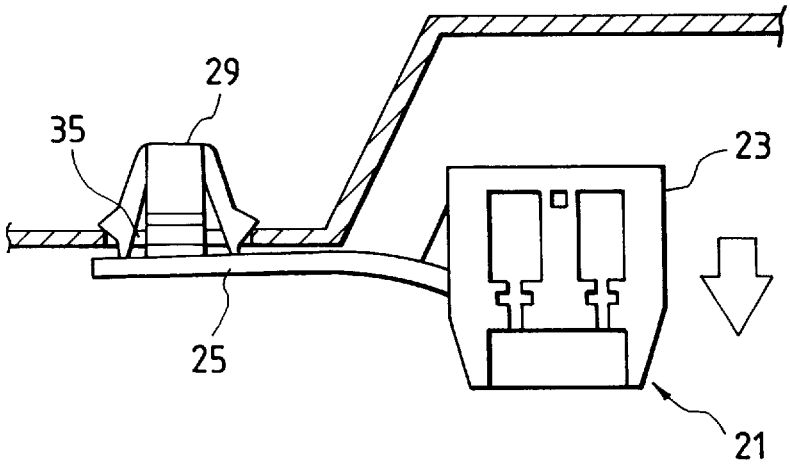
FIG. 5 is a side-elevational view showing a condition in which a load in a disconnecting direction is applied to the movable connector.

FIG. 3 is a side-elevational view showing a condition in which the movable connector is mounted on the mounting member, FIG. 4 is a side-elevational view showing a condition in which a load in the fitting direction is applied to the movable connector, and FIG. 5 is a side-elevational view showing a condition in which a load in a disconnecting direction is applied to the movable connector.

As shown in FIG. 3, the movable connector 21 of this construction is mounted on the roof bow 33, with the retaining portion 29, projecting from the support plate 25, inserted in the mounting hole 35 in the roof bow 33. Therefore, the connector housing 23 is located out of registry with the roof bow 33 projecting from the outer plate 37.

Namely, the connector housing 23 is received in a space between the outer plate 37 and a ceiling plate 39, and even when the space between the mounting surface of the roof bow 33 and the ceiling plate 39 is very narrow, the mounting of the movable connector can be effected if the space, corresponding to the thickness of the support plate 25, is secured.

When an excessive load in the fitting direction is applied to the movable connector 21, the support plate 25 is elastically displaced as shown in FIG. 4, so that the connector housing 23 is moved in the fitting direction, thereby preventing an undue force from acting on the retaining portion 29 and other portions. When removing a device (not shown), such as a cabin lamp, the connector housing 23 is pulled in the disconnecting direction to be disconnected from the mating connector. At this time, if this disconnecting force becomes excessive, the support plate 25 is elastically displaced as shown in FIG. 5, so that the connector housing 23 is moved, thereby preventing an undue force from acting on the retaining portion 29 and other portions.

To achieve these effects, the connector housing 23, connected to the support plate 25, needs to be located in such a manner that space t (see FIG. 3) is provided between the connector housing 23 and the outer plate 37 and also between the connector housing 23 and the side wall of the roof bow 33. Space t allows for free movement of the connector housing 23. The amount of free movement of housing 23 can be easily determined by adjusting the overall length of the connector housing 23 and the length of the support plate 25.

In the above movable connector 21, the support plate 25 extends from the side of the connector housing 23, and the retaining portion 29 is formed on and projects from the support plate 25. Therefore the retaining portion 29 does not need to be provided coaxially with the connector housing 23. Instead, the retaining portion 29 is disposed parallel to the connector housing 23, and with this construction the movable connector 21 can be mounted even in the narrow mounting space.

The retaining portion 29 projects from the support plate 25, and therefore even where the space between the mounting surface of the roof bow 33 and the ceiling plate 39 is very narrow, the connector housing 23 can be mounted out of registry with the roof bow 33 if the space for receiving the support plate 25 is secured. Therefore, with this construction, the mounting range is increased as compared with the conventional movable connector in which the retaining portion projects directly from the connector housing.

In the above movable connector 21, the support plate 25 is elastically displaceable. Therefore, when an excessive force is applied in the connector fitting direction and the disconnecting direction, the support plate 25 is elastically displaced, thereby relieving the load. As a result, the retaining portion 29, the connector housing 23 and other portions are protected from being damaged by such an excessive load.

In the movable connector 21, the insertion axis c of the retaining portion 29 is not aligned with the fitting axis e of the connector housing 23. The connector housing 23 can be rotated or turned about the insertion axis c, so as to correct for misregistration in those directions which can not be corrected by the conventional movable connector.

Figure 6:
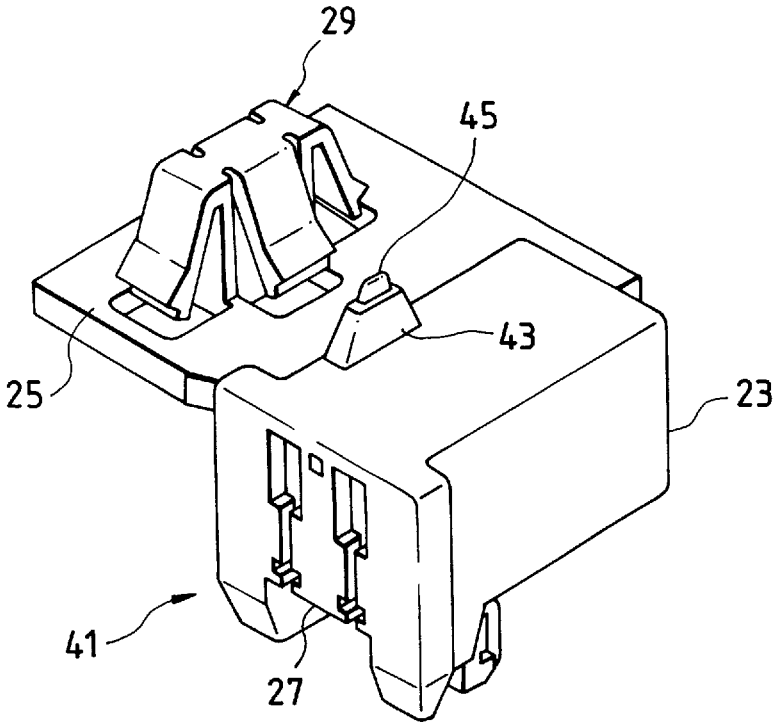
FIG. 6 is a perspective view of another embodiment of a movable connector of the invention.
Figure 7:
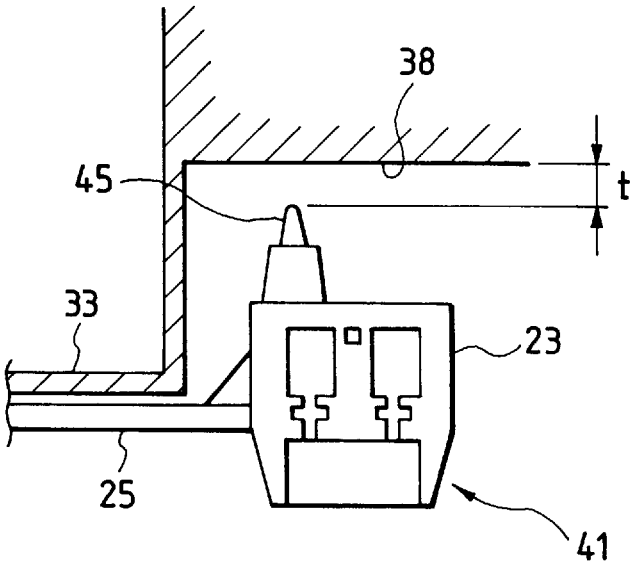
FIG. 7 is a side-elevational view showing a condition of mounting of the movable connector of FIG. 6.
Figure 8:
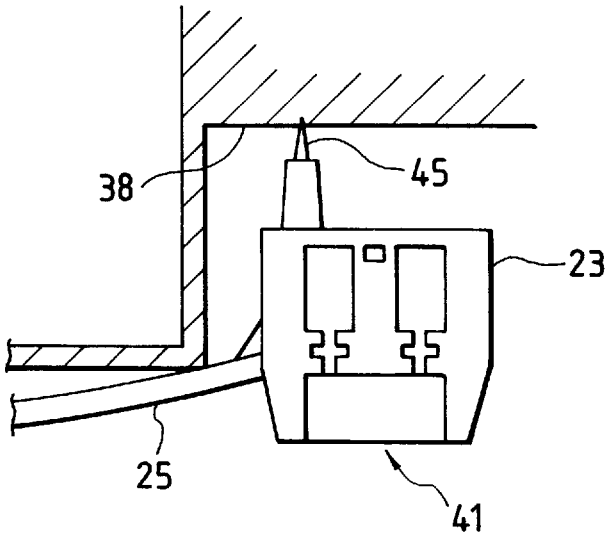
FIG. 8 is a side-elevational view showing a condition in which the movable connector of FIG. 6 is moved by an excessive load acting in a fitting direction.
Figure 9A:
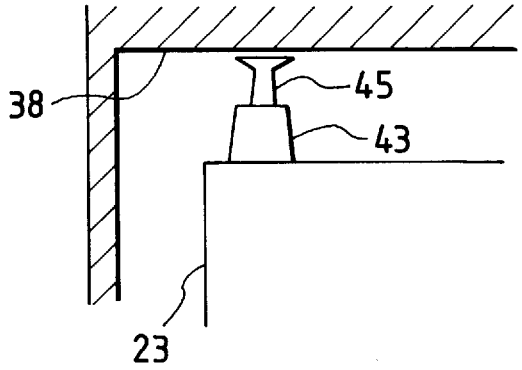
FIGS. 9(A) and 9(B) are views explaining the operation of a small projection.
Figure 9B:
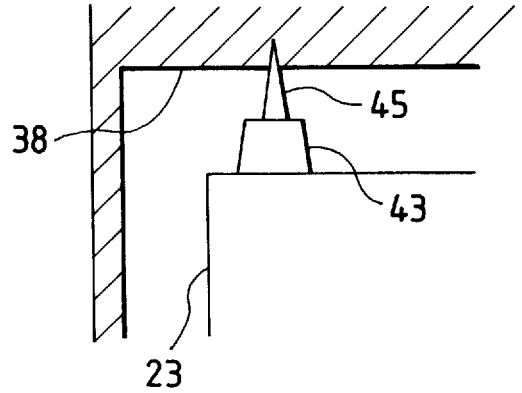
Figure 10:
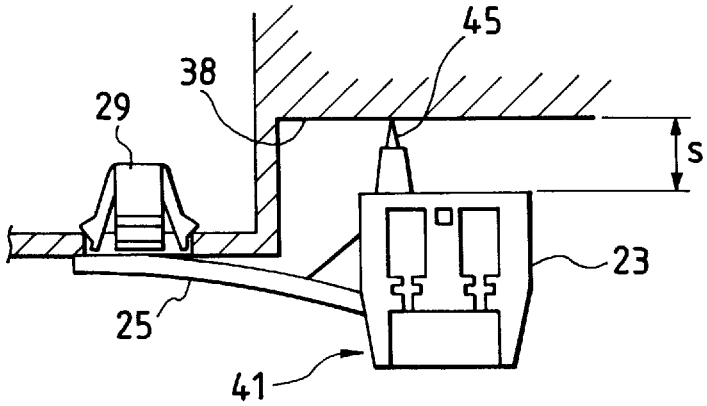
FIG. 10 is a side-elevational view showing a condition in which the movable connector of FIG. 6 is positioned by the small projection.
Figure 11:
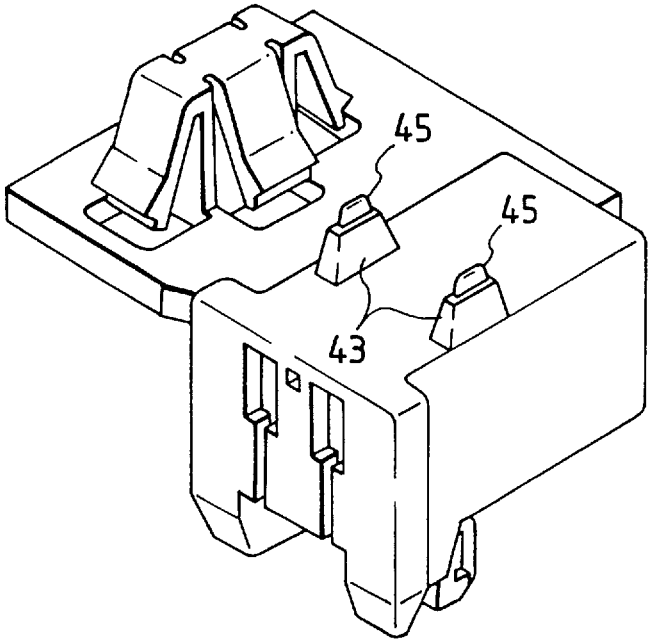
FIG. 11 is a perspective view of the movable connector having a plurality of small projections.

Another preferred embodiment of a movable connector of the present invention will now be described with reference to FIGS. 6 to 11. FIG. 6 is a perspective view of the movable connector of this embodiment, FIG. 7 is a side-elevational view showing the mounted condition of the movable connector of FIG. 6, FIG. 8 is a side-elevational view showing a condition in which the movable connector is moved by an excessive load acting in a fitting direction, FIG. 9 is a view explanatory of the operation of a small projection, FIG. 10 is a side-elevational view showing a condition in which the movable connector is positioned by the small projection, and FIG. 11 is a perspective view of the movable connector having a plurality of small projections. The movable connector 41 of this embodiment is identical to the above movable connector 21 in that a support plate 25 is formed integrally with a connector housing 23 and that a retaining portion 29 is formed on and projects from the support plate 25.

A suppressing projection 43 for limiting excessive displacement of the connector housing 23 is formed on a rear surface of the connector housing 23 facing away from a connector fitting surface 27, and projects in the same direction as the retaining portion 29. The small projection 45 is formed on a distal end of the suppressing projection 43 and, in the preferred embodiment, is formed integrally with the connector housing 23 (that is, the small projection 45 is made of the same resin material as that of the connector housing 23). The small projection 45 is designed so that when an excessive load is being applied in the direction of connection, the projection is crushed or deformed to absorb the excessive load.

In the movable connector 41 of this construction, when the support plate 25 is mounted on the roof bow 33, a space t for allowing the movement of the movable connector 41 is formed between the small projection 45 and an adjacent member 38. Namely, in the predetermined movable range, the small projection 45 does not contact the adjacent member 38.

On the other hand, when an excessive load acts on the connector housing 23 in the fitting direction, the support plate 25 is elastically displaced as shown in FIG. 8, and the connector housing 23 is moved toward the adjacent member 38 in an amount larger than the allowable movement amount. At this time, the small projection 45 is brought into contact with the adjacent member 38. If the load is large, the small projection 45 is crushed as shown in FIG. 9(A), or pierces into the adjacent wall as shown in FIG. 9(B), thereby limiting the movement of the connector housing 23 toward the adjacent member 38, thus preventing damage resulting from the excessive displacement of the support plate 25.

When a dimensional tolerance of a vehicle body-side portion cannot allow for the provision of space t, the connector housing 23 is displaced in such a direction that the gap between the rear surface of the connector housing 23 and the adjacent member 38 is smaller than t, as shown in FIG. 10. The small projection 45 is held against the adjacent member 38, and the connector housing 23 is kept spaced a predetermined distance s from the adjacent member 38 because of the elastic displacement of the support plate 25. Thus, even with such a dimensional tolerance of the vehicle body-side portion, the small projection 45 maintains the connector housing 23 in the proper position. In this case, when an excessive fitting load is exerted at the time of fitting of the connector, the small projection 45 is crushed or pierces into the adjacent wall, thereby preventing damage to the retaining portion 29, the support plate 25 and the connector housing 23.

Figure 12:
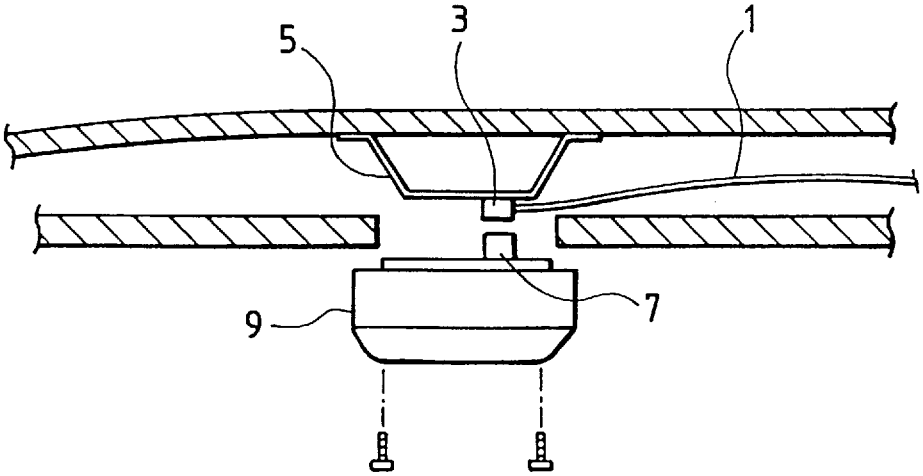
FIG. 12 PRIOR ART
FIG. 12 is a cross-sectional view showing a room lamp-mounting construction.
Figure 13:
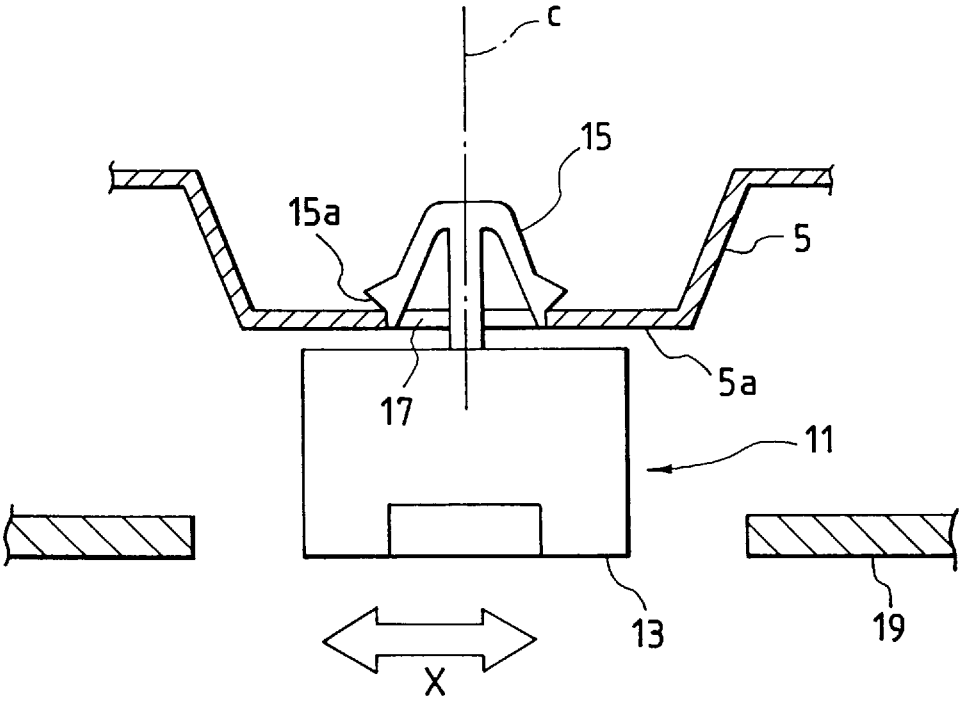
FIG. 13 PRIOR ART
FIG. 13 is a side-elevational view showing a conventional movable connector mounted on a mounting member.

In this movable connector 41, the suppressing projection 43 is formed on the rear surface of the connector housing 23, and therefore excessive deformation, occurring when mounting the lamp by tightening screws (see FIG. 12), is prevented. Moreover, when the connector housing 23 is moved by an excessive fitting load, the small projection 45 is crushed or pierces into the adjacent wall, thereby preventing damage to the retaining portion 29, the support plate 25 and the connector housing 23.

When the space for receiving the connector housing 23 is reduced due to a dimensional tolerance, the small projection 45 is held against the adjacent member 38 to thereby locate the connector housing 23 in the proper position.

In the above embodiment, although the movable connector 41 has one small projection 45, two small projections 45 may be formed respectively on the opposite side portions of the rear surface of the connector housing 23 as shown in FIG. 11, or more than two small projections 45 may be formed on this rear surface. In this construction in which the plurality of small projections 45 are provided, the excessive load can be well balanced, and the small projections 45 can operate more effectively.

As described above in detail, in the movable connector of the present invention, the support plate extends from the side of the connector housing, and the retaining portion is formed on and projects from this support plate, and the retaining portion and the connector housing are disposed parallel to each other. Therefore, the movable connector can be mounted even in a narrow mounting space. The support plate, interconnecting the retaining portion and the connector housing, is elastically displaceable, and therefore even when an excessive load is applied in the connector fitting direction and in the disconnecting direction, the support plate is elastically displaced, thereby relieving the load. As a result, the retaining portion and the connector housing are prevented from being damaged by the excessive load. The axis of insertion of the retaining portion and the axis of fitting of the connector are different from each other, and therefore the connector housing can be rotated or turned about the above insertion axis to correct for misregistration in those directions which can not be corrected by the conventional movable connector.

What is claimed is:

1. A movable connector having a connector housing and structured for correcting a misregistration of the connector housing with a mating connector which are mateable along a mating axis extending in a horizontal direction, said connector comprising:

an elastic support plate which is formed integrally with the connector housing and which extends from only one side of the connector housing perpendicular to said mating axis such that the connector housing is supported in a cantilevered manner on one end of;

a retaining portion which is formed on one face of said elastic support plate and at another end of said elastic support plate, and which extends in a direction opposite that of a connector fitting surface of the connector housing, said retaining portion being movably insertable in a mounting hole formed in a mounting member so as to allow rotational movement of said support plate with respect to said mounting member;

wherein said elastic support plate allows deformation so as to permit the connector housing to move in a vertical direction with respect to said mounting member; and wherein vertical motion of said elastic support plate and rotational motion of said retaining portion correct misalignment between the connector housing and the mating connector.

2. A movable connector-mounting construction using a movable connector according to claim 1, in which said connector housing is attached to said mounting member through said support plate in such a manner that there is adequate space around said connector housing to allow for movement of said connector housing in order to correct any misalignment of said connector housing with respect to said mating connector.

3. A movable connector according to claim 1, in which a suppressing projection is formed on and projects from a rear surface of said connector housing facing away from the fitting surface of said connector housing so as to limit movement of said connector housing during connection and disconnection.

4. A movable connector according to claim 3, in which said suppressing projection is deformed under a load larger than a predetermined level.

5. A movable connector according to claim 1, in which said elastic support plate is attached to said connector housing at a close proximity to a connecting side of said connector housing, thereby allowing an electrical connection in such a manner so as to minimize a required space between a mounting member and a covering device.

* * * * *